US010502370B2

(12) United States Patent
Rieder et al.

(10) Patent No.: US 10,502,370 B2
(45) Date of Patent: Dec. 10, 2019

(54) SEMICONDUCTOR LAMP

(71) Applicant: LEDVANCE GmbH, Garching (DE)

(72) Inventors: Bernhard Rieder, Regensburg (DE); Shaozhu Yang, Guangdong (CN)

(73) Assignee: LEDVANCE GMBH, Garching bei Munchen (DE)

( * ) Notice: Subject to any disclaimer, the term of this patent is extended or adjusted under 35 U.S.C. 154(b) by 0 days.

(21) Appl. No.: 15/558,838

(22) PCT Filed: Feb. 17, 2016

(86) PCT No.: PCT/EP2016/053314
§ 371 (c)(1),
(2) Date: Sep. 15, 2017

(87) PCT Pub. No.: WO2016/146330
PCT Pub. Date: Sep. 22, 2016

(65) Prior Publication Data

US 2018/0112836 A1 Apr. 26, 2018

(30) Foreign Application Priority Data

Mar. 19, 2015 (DE) ..... 10 2015 205 030

(51) Int. Cl.
*F21K 9/272* (2016.01)
*F21V 17/16* (2006.01)
(Continued)

(52) U.S. Cl.
CPC ..... *F21K 9/272* (2016.08); *F21S 8/031* (2013.01); *F21V 17/164* (2013.01);
(Continued)

(58) Field of Classification Search
CPC .... F21K 9/272; F21V 19/0035; F21V 19/004; F21V 23/06; F21Y 2103/10
See application file for complete search history.

(56) References Cited

U.S. PATENT DOCUMENTS 8,523,394 B2 * 9/2013 Simon ..... F21V 25/04 362/249.05
2009/0290334 A1 * 11/2009 Ivey ..... F21V 23/06 362/219

(Continued)

FOREIGN PATENT DOCUMENTS

EP 2216859 A1 8/2010
EP 2395278 A2 12/2011

(Continued)

*Primary Examiner* — Julie A Bannan
(74) *Attorney, Agent, or Firm* — Hayes Soloway PC

(57) ABSTRACT

Semiconductor lamp having a straight, translucent tube whose open end faces can be closed by means of respective end caps, which end caps are plug-connected to the tube, a circuit board which is equipped with at least one semiconductor light source is installed in the tube and is in contact with at least one of the end caps, wherein both end caps are mechanically connected to one another by means of a connection element running in the tube, at least one of the end caps is arranged such that it can be displaced longitudinally with play with respect to the tube and thermal expansion of the connection element in a longitudinal direction of the tube is smaller than thermal expansion of the tube and wherein the connection element is snap-fitted to at least one of the end caps. The invention can for example be used for retrofit or replacement lamps for conventional elongate lamps (e.g., fluorescent lamps and tube lamps).

33 Claims, 6 Drawing Sheets

(51) Int. Cl.

| | |
|---|---|
| ***F21V 23/06*** | (2006.01) |
| ***F21S 8/00*** | (2006.01) |
| ***F21V 19/00*** | (2006.01) |
| *F21V 17/10* | (2006.01) |
| *F21Y 103/10* | (2016.01) |
| *F21Y 115/10* | (2016.01) |

(52) U.S. Cl.
CPC ..... *F21V 19/0035* (2013.01); *F21V 23/06* (2013.01); *F21V 17/104* (2013.01); *F21V 19/004* (2013.01); *F21Y 2103/10* (2016.08); *F21Y 2115/10* (2016.08)

(56) References Cited

U.S. PATENT DOCUMENTS

2010/0008085 A1 1/2010 Ivey et al.
2010/0201239 A1 8/2010 Mostoller et al.
2010/0277918 A1* 11/2010 Chen ..... F21V 23/00 362/249.02
2011/0085335 A1* 4/2011 Osawa ..... F21V 19/02 362/249.14
2011/0303928 A1* 12/2011 Kawabata ..... H01L 33/54 257/88
2012/0008316 A1* 1/2012 Ivey ..... F21V 19/003 362/217.13
2012/0182728 A1* 7/2012 Watanabe ..... F21K 9/175 362/218
2012/0293991 A1* 11/2012 Lin ..... F21K 9/272 362/225
2013/0119896 A1* 5/2013 Fukano ..... H01R 13/7175 315/312
2013/0301255 A1 11/2013 Kim et al.
2014/0268719 A1 9/2014 Wu
2015/0109802 A1* 4/2015 Chang ..... F21K 9/175 362/374
2015/0146418 A1 5/2015 Lin et al.
2015/0260379 A1* 9/2015 Li ..... F21V 19/0055 362/217.13
2015/0292681 A1* 10/2015 Liang ..... F21V 23/02 362/222
2016/0176336 A1* 6/2016 Hoek ..... B60Q 1/323 362/549

FOREIGN PATENT DOCUMENTS

EP 2525131 A1 11/2012
EP 2587115 A1 5/2013
EP 2679891 A1 1/2014
EP 2843291 A1 3/2015
JP 2013235688 A 11/2013
JP 201463616 A 4/2014
JP WO2015068306 * 5/2015 ..... F21K 9/27
WO 2014001474 A1 1/2014

* cited by examiner

SEMICONDUCTOR LAMP

CROSS-REFERENCE TO RELATED APPLICATION AND PRIORITY

This patent application is a U.S. National Stage of International Patent Application No. PCT/EP2016/053314 filed on Feb. 17, 2016, which claims priority from German Patent Application No. 102015205030.0 filed on Mar. 19, 2015. Each of these patent applications is herein incorporated by reference in its entirety.

The invention relates to a semiconductor lamp, comprising a straight, translucent tube whose open end faces can be closed by means of respective end caps, and a circuit board equipped with at least one semiconductor light source which is accommodated in the tube and is electrically contacted by at least one of the end caps. The invention can be applied to retrofit or replacement lamps for conventional elongated lamps, e.g. fluorescent lamps and tubular lamps.

In the semiconductor lamps concerned, a plastic tube is frequently used as the bulb. The end caps are usually fitted firmly onto the open end faces in order to prevent them being pulled off and if necessary to establish air-tightness. At the same time, it is disadvantageous that during a temperature change the plastic tube expands (elongates or contracts) greatly in the longitudinal direction of the tube by comparison with a glass tube such that the length of the semiconductor lamp also changes correspondingly.

US 2010/0008085 A1 discloses a method for forming an LED-based light for replacing a conventional fluorescent lamp in a fluorescent light fixture which comprises: forming an elongated metal sheet from a highly heat-conducting material in order to create a heat sink. Forming the heat sink allows the heat sink to be configured so as to define cover and end cap attachment structures, mounting surfaces for LEDs at various angles and a high surface-to-width ratio for heat dissipation.

WO 2014/001474 A1 relates to a lighting device having a housing and an electronic assembly accommodated in the housing, said device also having at least one adjusting mechanism on at least one side of the electronic assembly, and the adjusting mechanism being operatively connected to the electronic assembly and being operable from outside the housing such that the electronic assembly is held in tension in the housing.

EP 2 395 278 A2 discloses a lighting device comprising a light source unit which has light-emitting units arranged in a longitudinal direction. A transparent covering element, which is formed in a substantially straight tube shape and has openings at both ends, is designed to hold the light source unit in the longitudinal direction. The covering element has a higher coefficient of thermal expansion than the light source unit. End plate elements are attached to both ends of the light source unit and close the openings at both ends of the covering element.

The object of the present invention is to overcome the disadvantages of the prior art at least in part and, in particular, to provide a semiconductor lamp of the type in question which only undergoes a slight change in length under temperature changes and is particularly easy to manufacture.

This object is achieved according to the features of the independent claims. Preferred embodiments can be inferred in particular from the dependent claims.

The object is achieved by a semiconductor lamp, comprising a straight, translucent tube whose open end faces can be closed by means of respective end caps, which end caps are plug-connected to the tube, and a circuit board equipped with at least one semiconductor light source which is accommodated in the tube and is electrically contacted by at least one of the two end caps, both end caps being mechanically connected to one another by means of a connecting element extending in the tube, at least one of the end caps being arranged such that it can be displaced longitudinally with play with respect to the tube, and a thermal expansion of the connecting element in a longitudinal direction of the tube being less than thermal expansion of the tube, and the connecting element being snap-fitted to at least one of the end caps.

The advantage due to the snap-fitting is that the semiconductor lamp can be assembled simply by plugging it together or by means of a simple plug-in movement.

It is possible to dispense with time-consuming screwing together. Thus, it is also possible to dispense with using an adhesive since this tends to evaporate into the tube and may damage light-emitting or electronic components. Moreover, a snap-in connection can be implemented by means of comparatively easy to manufacture components.

Attachment of the end caps to the connecting element with simultaneous longitudinal displaceability of the tube in respect of at least one of the end caps also has the advantage that a thermal change in length of the semiconductor lamp is determined by the change in length of the connecting element and not by the change in length of the tube. Since the thermal expansion of the connecting element in a longitudinal direction of the tube is less than the thermal expansion of the tube, this change in length is less than with a tube fixedly attached to the end caps. The tube may be longitudinally displaceable in respect of both end caps or may only be longitudinally displaceable in respect of one of the end caps.

The translucent tube can be a transparent and/or a diffuse tube. The tube can in particular have a hollow cylindrical basic shape with, for example, a circular cross-sectional shape. The tube can also be referred to as a tubular bulb, tube bulb or bulb tube.

The end caps can also be referred to or used as sockets, end pieces or closure pieces. In particular, both end caps are used for mounting the semiconductor lamp in a corresponding fitting. In this case, in one variation, only one of the end caps may be also used for electrical contacting. Alternatively, both end caps can also be used for electrical contacting. For example, electrically conductive contact pins, e.g. for bi-pin connectors, can be provided for electrical contacting.

A driver for converting electrical signals fed in via at least one end cap into operating signals for operating the at least one semiconductor light source can be accommodated in at least one of the end caps. The driver may be arranged in only one end cap, be divided between both end caps and/or be arranged at least in part on the circuit board equipped with at least one semiconductor light source. The driver or a part thereof may comprise one or more driver modules arranged on a separate circuit board ("driver circuit board"). If an end cap comprises the driver or a part of the driver, thus the part of this end cap comprising the electrical contact can also be referred to as "end cap contact part". The end cap then comprises in particular the end cap contact part and the driver attached thereto.

In a development, the connecting element is connected directly to the end cap contact part of at least one end cap. In another development, the connecting element is also connected to the driver (or a part thereof) of at least one end cap, thus it is connected only indirectly to the end cap contact part via this driver.

The fact that the end caps are fitted to the tube can mean that the end caps are inserted into the tube (towards the inside) and/or that the end caps are fitted onto the tube (from the outside). Fitting together means in particular that the end caps are at least partially inserted into the tube and/or are fitted onto the tube.

In particular, the at least one semiconductor light source comprises at least one light-emitting diode. If several light-emitting diodes are present, they can light up in the same colour or in different colours. A colour can be monochrome (e.g. red, green, blue, etc.) or multichrome (e.g. white). The light from the at least one light-emitting diode can also be an infra-red light (IR-LED) or an ultraviolet light (UV-LED). A plurality of light-emitting diodes can produce a mixed light; e.g. a white mixed light. The at least one light-emitting diode can contain at least one wavelength-converting fluorescent substance (conversion-LED). The fluorescent substance can be arranged alternatively or additionally remote from the light-emitting diode (remote phosphor). The at least one light-emitting diode can be present in the form of at least a singly housed light-emitting diode or in the form of an LED chip. A plurality of LED chips can be mounted on a common substrate (submount). The at least one light-emitting diode can be equipped with at least one separate and/or common lens for beam guidance, e.g. at least one Fresnel lens, collimator, and so on. Instead of or in addition to inorganic light-emitting diodes, e.g. based on InGaN or AlInGaP, organic LEDs (OLEDs, e.g. polymer OLEDs) are generally also usable. Alternatively, the at least one semiconductor light source can comprise, for example, at least one diode laser.

The circuit board fitted with the at least one semiconductor light source can be a flexible or rigid strip-shaped circuit board. It can then also be referred to as a "light strip". The at least one semiconductor light source can be present, for example, as a row of LEDs, e.g. of LED chips, aligned in the direction of extension of the circuit board.

For the circuit board to be contacted by both end caps, it comprises in particular mechanical contacting and, for at least one of the two end caps, also electrical contacting. The contacting can be implemented directly or indirectly (e.g. via a driver or a part thereof).

For at least one of the end caps to be arranged such that it can be displaced longitudinally with play, can mean that—at least for a predetermined temperature range, such as between −20° C. and +70° C., 0° C. and 50° C. etc.—the tube has play or a possible displacement path in the longitudinal direction in respect of at least one of the end caps, in particular in respect of both end caps.

In addition to a snap-fitting, the end cap can also be bonded and/or clamped, etc. to the connecting element. Basically, the snap-fitting can be releasable or (without destroying the semiconductor lamp) non-releasable.

For the connecting element to be snap-fitted to at least one of the end caps, can mean that the end cap has at least one snap-in protrusion which engages in at least one snap-in receiver of the connecting element, and/or that the connecting element has at least one snap-in protrusion which engages in at least one snap-in receiver of the end cap.

In an especially advantageous embodiment, the connecting element comprises at least one snap-in cut-out which can be brought into snap-in engagement with at least one snap-in protrusion of a respective end cap since this can usually be implemented more easily than the reverse arrangement. This is particularly the case if the connecting element is flat, e.g. is a sheet metal strip.

In yet another embodiment, the connecting element is a strip-shaped, metallic connecting element. Such a connection element is particularly easily manufactured and inserted into the tube and is robust. Metal has a noticeably lower coefficient of thermal expansion a than plastic, for example, such that a smaller linear expansion is enabled than with a non-movable attachment of the tube to the end caps. For example, the coefficient of thermal expansion for steel is around $\alpha=12\cdot10^{-6}$/K, for aluminium around $24\cdot10^{-6}$/K, for polycarbonate (PC) around $70\cdot10^{-6}$/K, for polyamide (PA) around $110\cdot10^{-6}$/K, for polyvinylchloride (PVC) around $80\cdot10^{-6}$/K and for polymethyl methacrylate (PMMA) around $80\cdot10^{-6}$/K.

The connecting element, for example, can be an aluminium strip or a steel strip or an element made from a steel strip. The strip can also be referred to as a profile or strap. In this case in particular, the snap-in receiver of the connecting element can be a continuous snap-in cut-out because this can be introduced particularly easily and, particularly with thin strips, provides sufficient depth for the engagement of a snap-in protrusion.

In a further embodiment, for snap-fitting with a respective end cap, the connecting element comprises at least one fold-over region or fold-over having a snap-in receiver, in particular a snap-in cut-out. As a result, a material reinforcement is provided in the region of the snap-in receiver which also enables a greater depth of said snap-in receiver for holding the associated snap-in cap particularly securely. The fold-over region or fold-over is located on one or both end portions of the connecting element and is particularly easy to manufacture. Thus, on the fold-over region, at least two layers—e.g. of a metal strip—lie on top of each other, wherein the snap-in receiver being formed by introducing a cut-out into at least one layer. When introduced into a plurality of layers, the respective cut-outs lie above one another.

In an alternative or additional embodiment, the connecting element comprises at least one snap-in cut-out for snap-fitting to a respective end cap, adjoining which snap-in cut-out is a region (referred to in the following as a "securing region" without limitation in the general sense) protruding inwards in the manner of a ramp towards a nearest open end face. This enables the snap-in protrusion to slide over the securing region into the snap-in cut-out which is located behind the securing area in the direction of insertion (in the following without restricting the generality also referred to as the direction of attachment, push in or push on) of the end cap, and represents an additional snap-fitting element for the snap-in protrusion which has slid in. Thus, the end cap is particularly securely prevented from being pulled out of the tube.

In another alternative or additional embodiment, the connecting element comprises at least one snap-in cut-out for snap-fitting with a respective end cap, out of which snap-in cut-out a material region is folded over towards a nearest open end face. As a result, a material reinforcement of the connecting element is achieved which makes it difficult to release the snap-in connection between the associated end cap and the connecting element.

In a development, the circuit board rests flat on the connecting element. As a result, the connecting element, particularly if it consists of a good heat-conducting material such as metal, can also be used as a heat sink for the circuit board and therefore for the at least one semiconductor light source located on the circuit board.

To establish particularly low thermal resistance between the circuit board and the connecting element, the circuit board can be attached firmly to the connecting element, e.g. can be bonded thereto, for example by means of double-sided adhesive tape, or a thermal compound, etc. The circuit board can additionally or alternatively be screwed, riveted, clamped, clipped, etc. to the connecting element.

In yet another embodiment, the circuit board rests loosely on the connecting element. As a result, the circuit board and the connecting element can move against each other such that it is possible to reduce or even prevent the introduction of tension into the circuit board due to a thermal mismatch. This embodiment is particularly advantageous if the coefficient of linear expansion of circuit board and connecting element differ perceptibly.

However, it is also possible for the circuit board and the connecting element to be spaced apart from each other, that is, they do not touch each other or at least not over a large surface area (but rather, e.g. only at certain points). As a result, it is possible to prevent them particularly effectively from influencing each other mechanically.

In yet another development, the circuit board is connected directly to the end cap contact part of at least one end cap. In another development, the circuit board is also connected to the driver (or part thereof) of at least one end cap, thus is connected only indirectly to the end cap contact part via this driver.

In another development, the circuit board is also connected by means of an electrical plug-in contact to at least one end cap (i.e. to its end cap contact part or driver), the plug-in contact being displaceable towards its plug-in contact counterpart while retaining its electrical contact. This is particularly advantageous if the coefficients of linear expansion of circuit board and connecting element differ perceptibly. For example, the plug-in contact can be mounted on the circuit board. The plug-in contact counterpart, for example, can be the driver circuit board itself or a plug-in contact counterpart mounted on the driver circuit board. The plug-in contact counterpart may also have a clamping effect.

In a further embodiment, the connecting element is integrated in the circuit board. This enables a particularly compact and easy to assemble internal structure of the semiconductor lamp. For example, the connecting element may comprise a metal strap or a metal strip which, for example, is formed as described above, wherein at least one semiconductor light source being arranged on at least one flat side thereof.

For electrical insulation against the—e.g. electrically conductive—connecting element the at least one semiconductor light source may already be electrically insulated itself on the underside (i.e. on its support surface) and/or there may be an electrical insulation layer between the connecting element and the at least one semiconductor light source.

In an alternative embodiment, the tube is a plastic tube. A plastic tube is inexpensive to manufacture and does usually not splinter. The invention is particularly advantageously applicable to this embodiment since the plastic tubes usually used have a problematically high coefficient of thermal expansion in the range typically above approx. $70 \cdot 10^{-6}$/K. The plastic can comprise, for example, PC, PA, PVC, PMMA, etc. It can be transparent or diffuse scattering.

In another embodiment, the tube is formed on the inside as a linear guide for the circuit board and/or for the connecting element. This enables accurate positioning of the circuit board and/or of the connecting element in the tube without preventing simple introduction in the longitudinal direction (e.g. pushing or plugging in). The linear guide in particular prevents freedom of movement perpendicular to the longitudinal direction. The linear guide can be used in particular as a limit stop against a movement perpendicular to the longitudinal direction and thus provide a form-fitting holder in this direction.

In another embodiment, the tube comprises protrusions projecting inwards which hold the circuit board perpendicular to the longitudinal direction in the tube. Such an embodiment is particularly easy to implement. These protrusions can be formed, for example, as tracks or dimples. They can be manufactured in one piece with the remaining tube, e.g. by means of an injection moulding process. Alternatively, they can have been introduced subsequently, e.g. by adhesion or also by reshaping the tube.

In yet another embodiment, the connecting element is also arranged in a cavity formed between the circuit board and the tube. As a result, the circuit board can act as the cover of the cavity and hold the circuit board therein. This gives rise in particular to the advantage that the circuit board can prevent bending of the connecting element since it acts as a limit stop against it.

In addition, in another embodiment, the tube is equipped on the inside with a receiver for the connecting element which holds the connecting element in a form-fitting manner in a transverse direction. This enables even further improved positioning accuracy of the connecting element.

Moreover, in one embodiment, the semiconductor lamp is a replacement lamp or retrofit lamp. For this it has at least approximately the form factor of the conventional tubular lamp to be replaced (e.g. fluorescent lamps or tubular lamps). In particular, it fits into lamp sockets intended for conventional lamps.

For example, the semiconductor lamp can be a retrofit lamp for replacing fluorescent lamps of the T type, e.g. the T5 or T8 type. The end caps in particular then have the form factor of G5 and G13 sockets, for example due to the presence of two contact pins. The tube in particular can then have a diameter like the bulbs of the conventional fluorescent lamps.

The properties, features and advantages of this invention described above and the way in which they are achieved, will be more clearly and distinctly understood in conjunction with the following schematic description of embodiments which will be explained in greater detail in connection with the drawings. For the sake of clarity, identical or equivalent elements can be provided with the same reference numbers.

FIG. 1 shows a sectional diagram in lateral view of an end-side portion of a semiconductor lamp 1 according to a first embodiment. FIG. 2 shows the semiconductor lamp 1 in part as a sectional diagram in oblique view.

Figure 1:
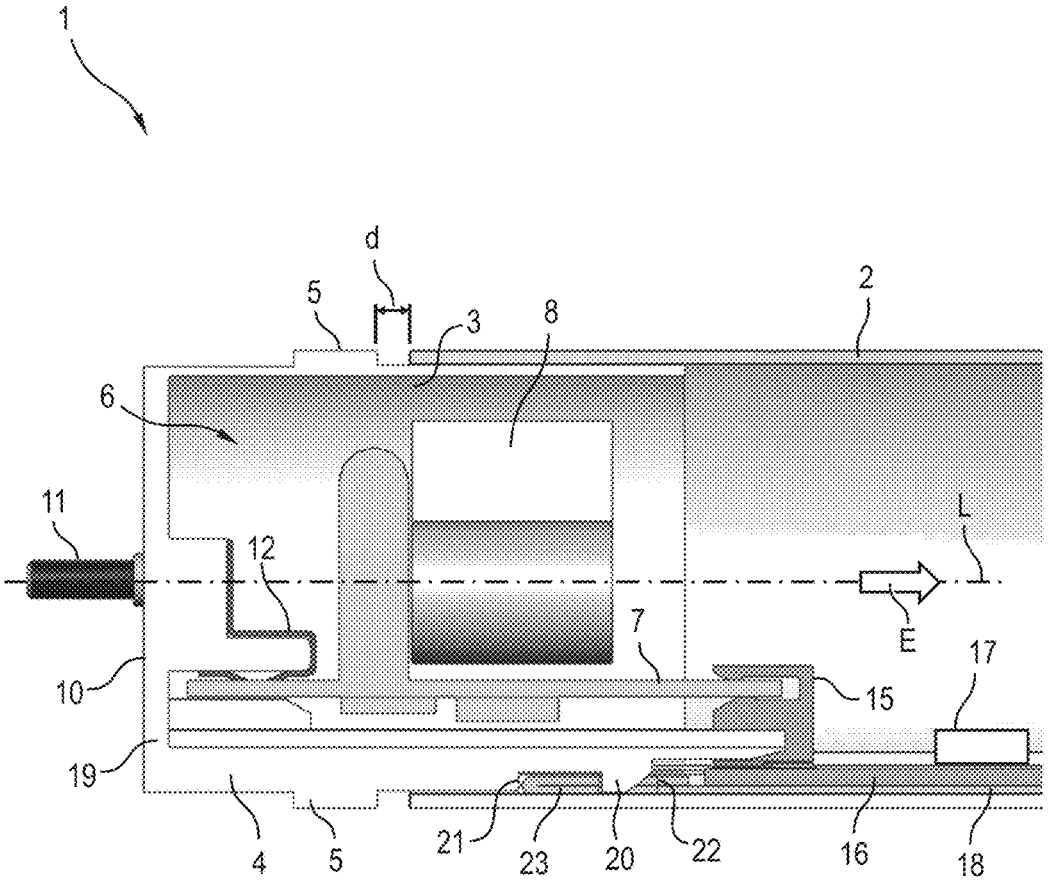
FIG. 1 shows a sectional diagram in lateral view of a detail from a semiconductor lamp according to a first embodiment.
Figure 2:
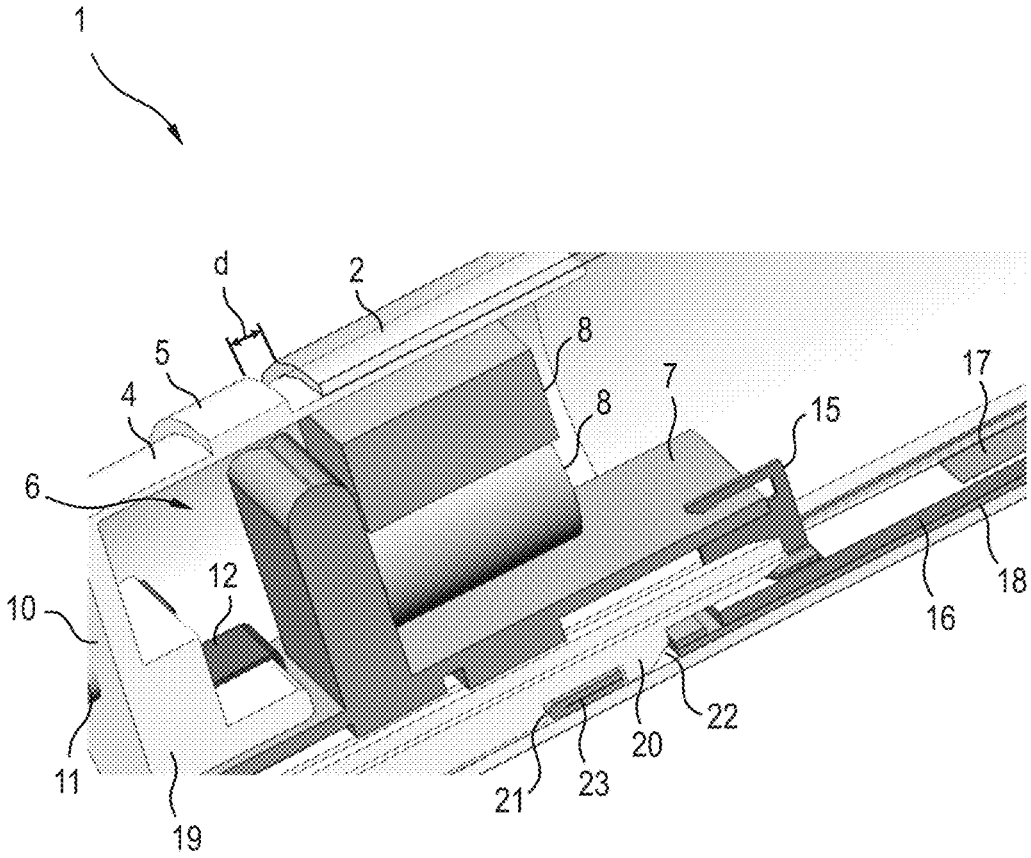
FIG. 2 shows a sectional diagram in oblique view of a further detail of the semiconductor lamp according to the first embodiment.

The semiconductor lamp 1 intended as a retrofit lamp, e.g. to replace a T8 fluorescent lamp, comprises a straight, translucent tube 2 having a hollow cylindrical basic shape made of transparent or opaque plastic. The tube 2 comprises, for example, open end faces 3 on both sides which can be closed by means of respective end caps 4.

For this purpose, the end caps 4 have a hollow cylindrical shape which is open in the direction of the tube 2 so that they can be inserted into the tube 2 up to a predetermined maximum penetration depth, e.g. in the manner of a plug. Here, the maximum penetration depth is predetermined by a casing-side, annular external prominence 5 which serves as a limit stop for the tube 2. The end caps 4, however, should not be inserted into the tube 2 to the maximum in order to leave a longitudinal play d in a longitudinal direction L of the tube 2. The end caps 4 fit tightly into the tube 2 radially or with only a small amount of radial play.

A driver 6, having a driver circuit board 7, which is equipped with a plurality of driver modules 8, is accommodated in the interior of the end cap 4 shown. Two electrically conductive contact pins 11, which are electrically connected to the driver 6 (e.g. via a contact strip 12) and can be fed via the electrical supply signals, lead through an end face 10 of the end cap 4 directed away from the tube 2. The driver 6 converts the electrical supply signals into electrical operating signals for semiconductor light sources in the form of LEDs 17, for example.

The driver circuit board 7 is inserted into an electrical plug-in contact 15 in a longitudinally displaceable manner and electrically contacts the latter. The electrical plug-in contact 15 is arranged on an upper side of a strip-shaped circuit board 16 which is also equipped with a plurality of LEDs 17 arranged along the longitudinal direction L. The plug-in contact 15 is displaceable towards the driver circuit board 7 while maintaining an electrical contact, which is particularly advantageous for preventing stresses in the circuit board 16.

The circuit board 16 rests loosely with its underside on a strip-shaped connecting element in the form of a steel strip 18. The steel strip 18 is snap-fitted at one end with the end cap 4, here with an end cap contact part 19 comprising the contact pins 11. The end cap 4 can thus also be regarded as a system composed of the end cap contact part 19 and the driver 6.

The snap-fit-mechanism comprises a snap-in protrusion 20 of the end cap 4 projecting outwards on the casing side, said protrusion comprises a chamfer in an insertion direction E of the end cap 4 into the tube 2. On the side of the snap-in protrusion 20 directed away from the tube 2, the end cap 4 also has a recess 21 introduced into the outer circumferential surface of the end cap 4.

As snap in counterpart, the steel strip 18 comprises a snap-in cut-out 22 for engaging with the snap-in protrusion 20. The steel strip further comprises a protrusion directed inwards in the form of a fold-over 23 for accommodation in the recess 21.

The end cap 4 shown is rigidly connected mechanically via the steel strip 4 to an end cap (not illustrated) sealing the other end face of the tube 2. The connection of the two end caps 4 can be free from play in the longitudinal direction L or may have only slight play. The two end caps 4 can be of identical shape. Due to the mechanically rigid connection of the two end caps 4 to each other via the steel strip 18 and due to the existing play d, the tube 2 is arranged so as to be (longitudinally) displaceable in the longitudinal direction L (in and against the direction of insertion E) towards the end caps 4.

Figure 3:
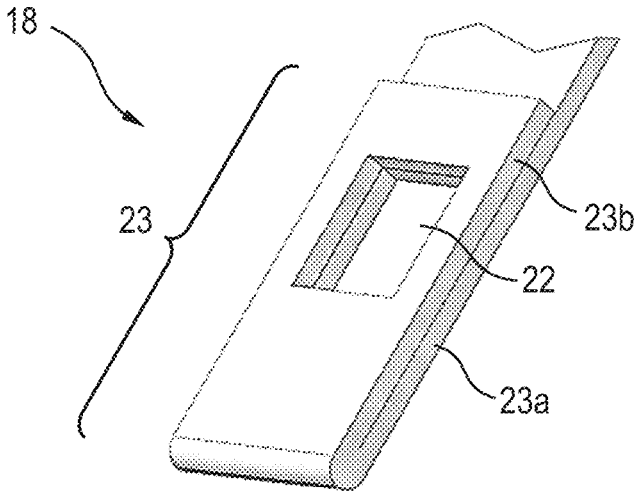
FIG. 3 shows in oblique view a detail from a connecting element of the semiconductor lamp according to the first embodiment.

A temperature-dependent change in length of the semiconductor lamp 1 as such is substantially determined by the comparatively small change in length of the steel strip 18. As the longitudinal expansion coefficient of the steel of the steel strip 18 is considerably lower than that of the plastic of the tube 2, the play d becomes smaller when heated and larger when cooled. Therefore, a linear expansion of the tube 2 is compensated by a change in the play d. The size of the play d can be specified simply by knowing the longitudinal expansion coefficient of the steel strip 18 and of the plastic tube 2 as well as the desired temperature range (e.g. from −20° C. to 70° C., from 0° C. to 50° C. or similar). FIG. 3 shows an end-side detail from the connecting element 18. On the end side, the connecting element 18 comprises the fold-over region 23 which has been achieved, for example, by bending a flat steel strip by 180°. The fold-over region 23 comprises two layers 23*a* and 23*b* lying on top of each other, into which the respective congruent cut-outs have been introduced in order to form the snap-in cut-out 22 together.

Figure 4:
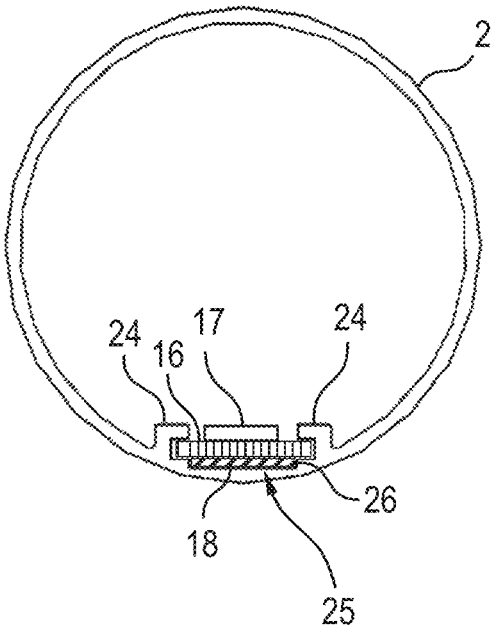
FIG. 4 shows the semiconductor lamp according to the first embodiment in cross-sectional view.

FIG. 4 shows the semiconductor lamp 1 in a cross-sectional view through the tube 2 at the level of an LED 17. The tube 2 is formed on the inside as a linear guide for the circuit board 16 and for the steel strip 18. For this purpose, the tube 2 comprises inwardly projecting protrusions 24 which hold the circuit board 16 perpendicular to the longitudinal direction L in the tube 2. The protrusions 24 can extend over a largish length or even over the entire length of the tube 2 or, for example, there may be a plurality of protrusions 24 spaced apart in the longitudinal direction L.

Together the circuit board 16 and the tube 2 form a cavity 25 in which the steel strip 18 is arranged. In this case, the steel strip 18 lies in a groove-like receiver 26 and is held therein by the circuit board 16. This has the advantage that the steel strip 18 is prevented from bending by the circuit board 16 and as a result from changing its desired length, for example.

Figure 5:
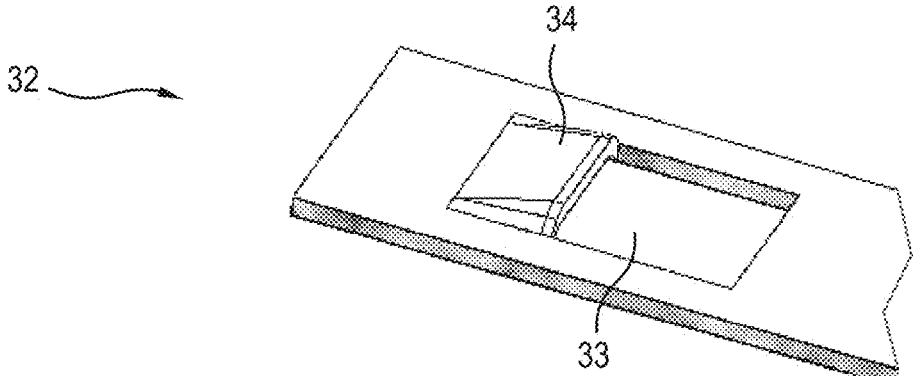
FIG. 5 shows in oblique view a detail from a connecting element of a semiconductor lamp according to a second embodiment.
Figure 6:
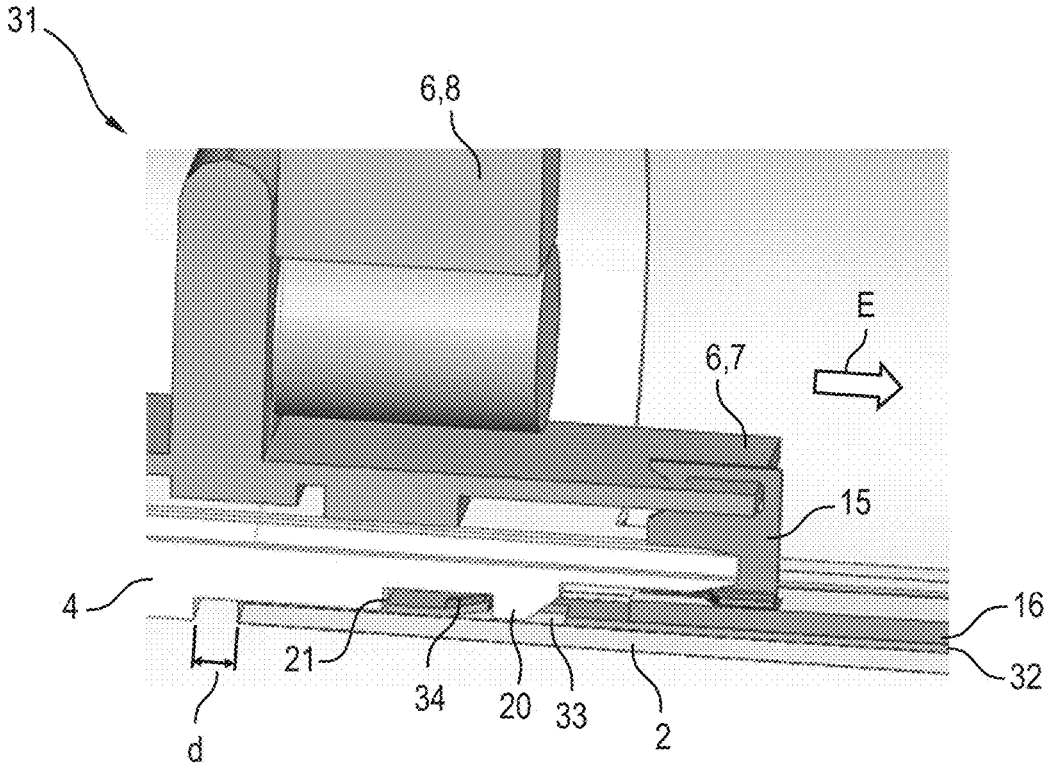
FIG. 6 shows a sectional diagram in oblique view of a detail of the semiconductor lamp according to the second embodiment.

FIG. 5 shows in an oblique view a detail from a steel strip 32 serving as a connecting element of a semiconductor lamp 31, said semiconductor lamp also comprising the end cap 4, the circuit board 16 and the tube 2. The steel strip 32 also comprises a snap-in cut-out 33 in its end region for engaging with the snap-in protrusion 20 of the end cap 4, as shown in FIG. 6.

A securing area 34 protruding in the manner of a ramp adjoins the snap-in cut-out 32 in the direction of the open end face (here: against the direction of insertion E of the end cap 4). The securing region 34 is arranged in the recess 21 of the end cap 4. When the end cap 4 is inserted, the snap-in protrusion 20 can slide in over and past the securing region 34 but is then prevented by said securing region from sliding out.

Figure 7:
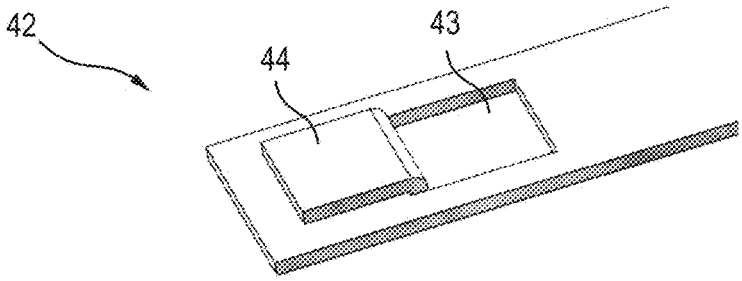
FIG. 7 shows in oblique view a detail from a connecting element of a semiconductor lamp according to a third embodiment.
Figure 8:
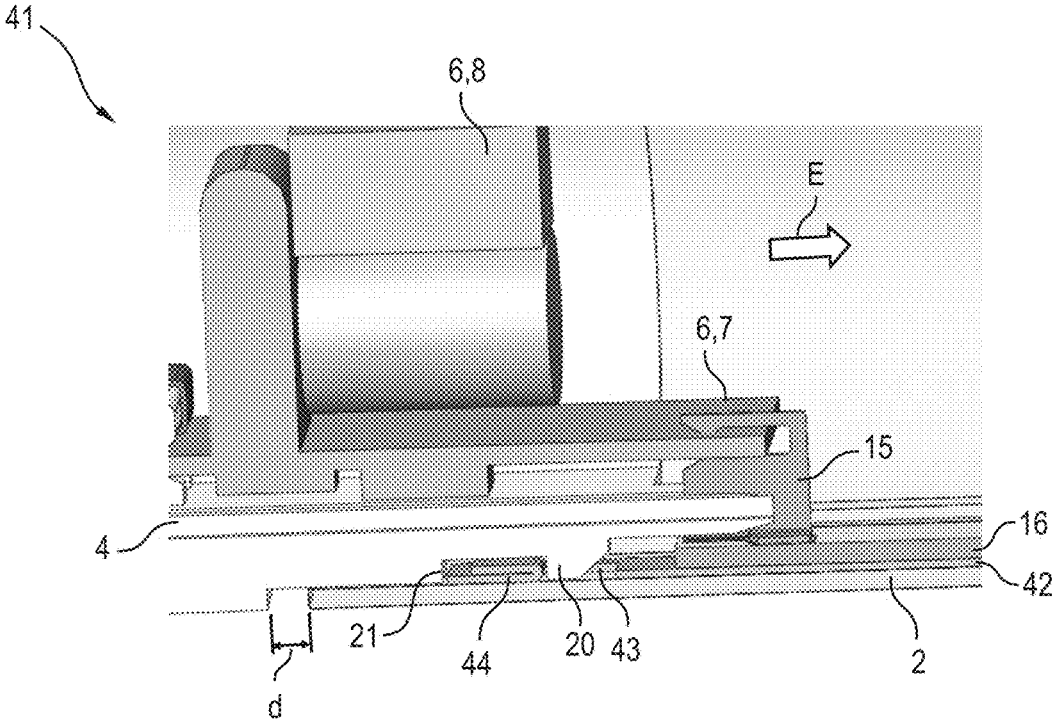
FIG. 8 shows a sectional diagram in oblique view of a detail of the semiconductor lamp according to the third embodiment.

FIG. 7 shows in an oblique view a detail from a steel strip 42 serving as a connecting element of a semiconductor lamp 41. The steel strip 42 also comprises a snap-in cut-out 43 in its end region for engaging with the snap-in protrusion 20 of the end cap 4 of the semiconductor lamp 41, as shown in FIG. 8. However, a material area 44 from the snap-in cut-out 43 is now folded over in the direction of a nearest open end face of the tube 2 (here: against the direction of insertion E of the end cap 4). The material region 44 is arranged in the recess 21 of the end cap 4.

Figure 9:
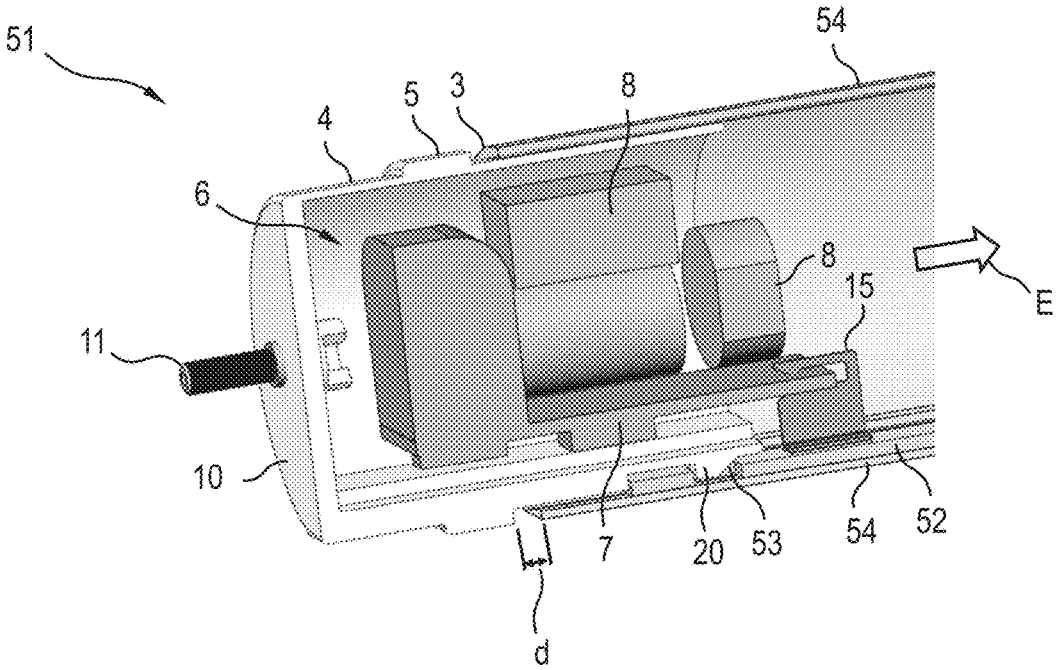
FIG. 9 shows a sectional diagram in oblique view of a semiconductor lamp according to a fourth embodiment.

FIG. 9 shows a sectional diagram in oblique view of a detail from a semiconductor lamp 51. Unlike the semiconductor lamps 1, 31 and 41, the semiconductor lamp 51 comprises a metallic connecting element which is integrated in a circuit board 52 and can serve, for example, as a core thereof. A simple snap-in cut-out 53 is then provided for engaging with the snap-in protrusion 20.

Figure 10:
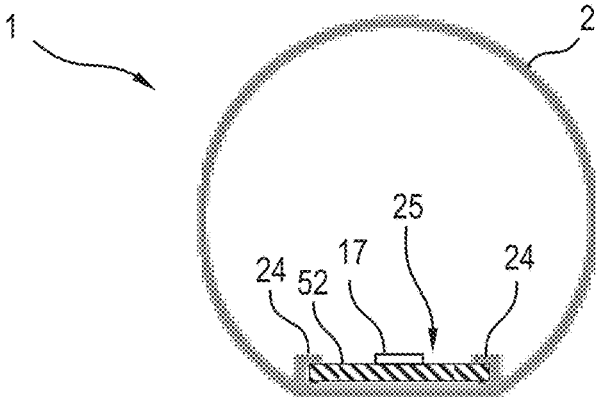
FIG. 10 shows the semiconductor lamp according to the fourth embodiment in cross-sectional view.

FIG. 10 shows the semiconductor lamp 51 in cross-sectional view through an LED 17. A tube 54 of the semiconductor lamp 51 is flattened on the back side of the circuit board 52 to prevent a gap between a back side of said circuit board 52 and said tube 54 in order to facilitate improved heat transfer from the circuit board 52 to the tube 54.

The semiconductor lamps 1, 31, 41 and 51 shown in the embodiments can be assembled particularly easily by inserting the circuit board and the metal strip (possibly integrated therein) into the tube and then inserting at least one end cap into said tube. As a result of the insertion process, the end cap is advantageously also snapped into the metal strip and inserted into the electrical plug-in contact of the circuit board. The other end cap can be mounted analogously or can have already been connected to the tube before insertion of the circuit board and the metal strip therein.

Although the invention has been illustrated and described in greater detail using the embodiments shown, the invention is not limited thereto and a person skilled in the art may derive other variations therefrom without departing from the scope of protection of the invention.

Thus, instead of the metal strip, for example, a connecting element—in particular strip-shaped—made of glass, circuit board material (such as FR4, CEM1, etc.) or ceramic can also be used. In particular, the connecting element itself can be a circuit board base body, in particular without metallisation.

Generally, "one", "a" etc. may be understood to mean a single figure or a plurality, particularly in the sense of "at least one" or "one or more", etc., as long as this is not explicitly excluded, e.g. by the expression "exactly one".

A specified figure may also include exactly the number and also a customary tolerance range, as long as this is not explicitly excluded.

REFERENCE NUMBERS

1 Semiconductor lamp
2 Tube
3 End face
4 End cap
5 External prominence
6 Driver
7 Driver board
8 Driver component
10 End face
11 Contact pin
12 Contact strip
15 Plug-in contact
16 Circuit board
17 LED
18 Steel strip
19 End cap contact part
20 Snap-in protrusion
21 Recess
22 Snap-in cut-out
23 Fold-over region
23*a* Layer of the fold-over region 23
23*b* Layer of the fold-over region 23
24 Protrusion
25 Cavity
26 Groove-like receiver
31 Semiconductor lamp
32 Steel strip
33 Snap-in cut-out
34 Securing region
41 Semiconductor lamp
42 Steel strip
43 Snap-in cut-out
44 Material region
51 Semiconductor lamps
52 Circuit board
53 Snap-in cut-out
54 Tube
d Longitudinal play
E Insertion direction
L Longitudinal direction

The invention claimed is:

1. A semiconductor lamp comprising:

a straight, translucent tube whose open end faces are configured to be closed by means of respective end caps, which end caps are configured to be plug-connected to the tube; and a circuit board which is equipped with at least one semiconductor light source which is configured to be accommodated in the tube and is configured to be contacted by at least one of the end caps;

wherein:

both end caps are configured to be mechanically connected to one another by means of a connecting element extending in the tube, wherein the connecting element is a strip-shaped, metallic connecting element, wherein the connecting element comprises at least one fold-over region for snap-fitting to a respective end cap, said fold-over region comprising a snap-in cut-out;

at least one of the end caps is arranged such that it is configured to be displaced longitudinally with play with respect to the tube;

thermal expansion of the connecting element in a longitudinal direction of the tube is smaller than thermal expansion of the tube; and the connecting element is configured to be snap-fitted to at least one of the end caps.

2. The semiconductor according to claim 1, in which the snap-in cut-out is configured to be brought into engagement with a snap-in protrusion of a respective end cap.

3. The semiconductor lamp according to claim 1, in which the circuit board rests loosely on the connecting element.

4. The semiconductor lamp according to claim 1, in which the connecting element is integrated into the circuit board.

5. The semiconductor lamp according to claim 1, in which the tube is a plastic tube.

6. The semiconductor lamp according to claim 1, in which the tube is formed on the inside as a linear guide at least one of for the circuit board and for the connecting element.

7. The semiconductor lamp according to claim 6, in which the tube comprises inwardly projecting protrusions which are configured to hold the circuit board perpendicular to the longitudinal direction in the tube.

8. The semiconductor lamp according to claim 7, in which the connecting element is arranged in a cavity formed between the circuit board and the tube.

9. The semiconductor lamp according to claim 1, in which the tube is equipped on the inside with a receiver for the connecting element which is configured to hold the connecting element in a form-fitting manner in a transverse direction.

10. The semiconductor lamp according to claim 1, in which the circuit board is configured to be electrically connected by means of an electrical plug-in contact to at least one end cap, wherein the plug-in contact is displaceable towards its plug-in contact counterpart while retaining its electrical contact.

11. The semiconductor lamp according to claim 1, in which the semiconductor lamp is a retrofit lamp.

12. A semiconductor lamp comprising:

a straight, translucent tube whose open end faces are configured to be closed by means of respective end caps, which end caps are configured to be plug-connected to the tube; and a circuit board which is equipped with at least one semiconductor light source which is configured to be accommodated in the tube and is configured to be contacted by at least one of the end caps;

wherein:

both end caps are configured to be mechanically connected to one another by means of a connecting element extending in the tube, wherein the connecting element is a strip-shaped, metallic connecting element, wherein the connecting element comprises at least one snap-in cut-out for snap-fitting to a respective end cap, adjoining which snap-in cut-out is a securing region protruding inwards in the manner of a ramp towards a nearest open end face;

at least one of the end caps is arranged such that it is configured to be displaced longitudinally with play with respect to the tube;

thermal expansion of the connecting element in a longitudinal direction of the tube is smaller than thermal expansion of the tube; and the connecting element is configured to be snap-fitted to at least one of the end caps.

13. The semiconductor according to claim 12, in which the at least one snap-in cut-out is configured to be brought into engagement with a snap-in protrusion of a respective end cap.

14. The semiconductor lamp according to claim 12, in which the circuit board rests loosely on the connecting element.

15. The semiconductor lamp according to claim 12, in which the connecting element is integrated into the circuit board.

16. The semiconductor lamp according to claim 12, in which the tube is a plastic tube.

17. The semiconductor lamp according to claim 12, in which the tube is formed on the inside as a linear guide at least one of for the circuit board and for the connecting element.

18. The semiconductor lamp according to claim 17, in which the tube comprises inwardly projecting protrusions which are configured to hold the circuit board perpendicular to the longitudinal direction in the tube.

19. The semiconductor lamp according to claim 18, in which the connecting element is arranged in a cavity formed between the circuit board and the tube.

20. The semiconductor lamp according to claim 12, in which the tube is equipped on the inside with a receiver for the connecting element which is configured to hold the connecting element in a form-fitting manner in a transverse direction.

21. The semiconductor lamp according to claim 12, in which the circuit board is configured to be electrically connected by means of an electrical plug-in contact to at least one end cap, wherein the plug-in contact is displaceable towards its plug-in contact counterpart while retaining its electrical contact.

22. The semiconductor lamp according to claim 12, in which the semiconductor lamp is a retrofit lamp.

23. A semiconductor lamp comprising:

a straight, translucent tube whose open end faces are configured to be closed by means of respective end caps, which end caps are configured to be plug-connected to the tube; and a circuit board which is equipped with at least one semiconductor light source which is configured to be accommodated in the tube and is configured to be contacted by at least one of the end caps;

wherein:

both end caps are configured to be mechanically connected to one another by means of a connecting element extending in the tube, wherein the connecting element is a strip-shaped, metallic connecting element, wherein the connecting element comprises at least one snap-in cut-out for snap-fitting to a respective end cap, out of which snap-in cut-out a material region is folded over towards a nearest open end face;

at least one of the end caps is arranged such that it is configured to be displaced longitudinally with play with respect to the tube;

thermal expansion of the connecting element in a longitudinal direction of the tube is smaller than thermal expansion of the tube; and the connecting element is configured to be snap-fitted to at least one of the end caps.

24. The semiconductor according to claim 23, in which the at least one snap-in cut-out is configured to be brought into engagement with a snap-in protrusion of a respective end cap.

25. The semiconductor lamp according to claim 23, in which the circuit board rests loosely on the connecting element.

26. The semiconductor lamp according to claim 23, in which the connecting element is integrated into the circuit board.

27. The semiconductor lamp according to claim 23, in which the tube is a plastic tube.

28. The semiconductor lamp according to claim 23, in which the tube is formed on the inside as a linear guide at least one of for the circuit board and for the connecting element.

29. The semiconductor lamp according to claim 28, in which the tube comprises inwardly projecting protrusions which are configured to hold the circuit board perpendicular to the longitudinal direction in the tube.

30. The semiconductor lamp according to claim 29, in which the connecting element is arranged in a cavity formed between the circuit board and the tube.

31. The semiconductor lamp according to claim 23, in which the tube is equipped on the inside with a receiver for the connecting element which is configured to hold the connecting element in a form-fitting manner in a transverse direction.

32. The semiconductor lamp according to claim 23, in which the circuit board is configured to be electrically connected by means of an electrical plug-in contact to at least one end cap, wherein the plug-in contact is displaceable towards its plug-in contact counterpart while retaining its electrical contact.

33. The semiconductor lamp according to claim 23, in which the semiconductor lamp is a retrofit lamp.

* * * * *